United States Patent [19]

Raque et al.

[11] Patent Number: 4,699,297

[45] Date of Patent: Oct. 13, 1987

[54] ASEPTIC FILLING ARRANGEMENT

[75] Inventors: Glen F. Raque; Edward A. Robinson, both of Louisville, Ky.

[73] Assignee: Raque Food Systems, Inc., Louisville, Ky.

[21] Appl. No.: 567,536

[22] Filed: Jan. 3, 1984

[51] Int. Cl.[4] ..... B67D 5/48

[52] U.S. Cl. ..... 222/148; 222/372

[58] Field of Search ..... 222/148, 188, 542, 554, 222/380, 372; 277/3, 135, 15; 137/241; 422/26

[56] References Cited

U.S. PATENT DOCUMENTS

| | | | |
|---|---|---|---|
| 1,795,932 | 3/1931 | Cornell, Jr. | 277/22 X |
| 3,693,640 | 9/1972 | Wettlen et al. | 222/148 X |
| 3,870,066 | 3/1975 | Jurasek | 137/241 X |
| 3,909,014 | 9/1975 | Loliger | 137/241 X |
| 4,094,638 | 6/1978 | Todtenhaupt et al. | 277/15 X |
| 4,178,929 | 12/1979 | Voegele | 222/380 X |
| 4,235,265 | 11/1980 | Feliks | 222/380 X |
| 4,273,263 | 6/1981 | Voegele et al. | 222/148 |
| 4,432,556 | 2/1984 | Green et al. | 277/15 X |

FOREIGN PATENT DOCUMENTS

| | | | |
|---|---|---|---|
| 2308689 | 9/1974 | Fed. Rep. of Germany | 222/148 |
| 294308 | 1/1971 | U.S.S.R. | 137/241 |

*Primary Examiner*—Joseph J. Rolla
*Assistant Examiner*—Nils Pedersen
*Attorney, Agent, or Firm*—Barnes & Thornburg

[57] ABSTRACT

An aseptic food handling system for filling containers with presterilized food. A first cylinder is provided having an inlet and an outlet, and located so food products to be packaged are received in the inlet. The cylinder contains a piston operable from first position to receive product through the inlet to a second position to emit the food product from the outlet. At least one sterilizing fluid passageway is provided in the cylinder to selectively admit sterilizing fluid to the cylinder to expose the internal surfaces of the cylinder and the poston to the sterilizing fluid where the cylinder can be operated by an adjustable two position motive cylinder. A second dispensing cylinder can also be provided to receive the food product from the first cylinder and direct it to a food container.

3 Claims, 20 Drawing Figures

26B
26C
15
3
10B
10C
10A
20
8D
11C
11B
11A
16
6
17
8F
8B
8C
8A
8
26A
26
9
2
2A
19
18
7

ASEPTIC FILLING ARRANGEMENT

BACKGROUND OF THE INVENTION

The present invention relates to food filling and packaging systems and more particularly to systems to aseptically fill containers, with presterilized food, to eliminate the need for sterilization of the entire filled container subsequent to filling.

Heretofore, it has been necessary to either sterilize the food and the container after filling or to introduce foreign substances which will preserve the food from both oxidation and bacteria growth.

The prior procedures are expensive in that they are both labor intensive and material cost expensive and even when used the procedures in many instances do not fully protect the food product from degradation. For example, in the case of whole milk or other perishable products, sale of the product must be accomplished within a specific period of time otherwise bacteria in the food product degrades the product and prevents use and the entire product package is lost. Alternatively food products must be refrigerated to prevent short term spoilage. Further, heat processing in prior art arrangements has resulted, in some instances, in poor quality control.

In other procedures such as canning, where the food products are put up in metal containers which are sterilized after packaging, cost of the containers is significant and the cost of processing is likewise significant.

Further, filling devices within the scope of the present invention can be utilized to fill liquid as well as liquid/particulate mixtures or liquid which subsequently hardens.

While certain prior art means of aseptic packaging are known, and presently utilized, no prior art equipment is known where high volume production can be accomplished and where the aseptic qualities can be preserved in the filling equipment by periodic sterilization of the equipment.

SUMMARY OF THE INVENTION

The present invention provides a new and useful arrangement for aseptic packaging of food and other perishable products wherein straightforward equipment design is provided to accomplish the aseptic packaging objective but where the cost of the equipment is reasonable and operation is not labor intensive so that a low cost aseptic product can be provided.

More particularly, the present invention provides arrangements wherein the product can be presterilized and handled in bulk.

Further procedures in accordance with the present invention permit the food product to be presterilized under carefully controlled conditions and then transferred and filled under sterile conditions.

Further, devices within the scope of the present invention can be utilized as aseptic filling operations and non aseptic filling operations. While the disclosure set forth hereinafter is described with relation to food products it will be understood that such devices can be equally satisfactorily utilized for other products. For example, the devices are particularly useful in "hot fill" applications, for example deodorants where the material is filled as a liquid and then sets up.

Briefly, the present invention provides, inter alia, an aseptic food handling system for filling containers with food which includes a first cylinder, having an inlet and an outlet, where food products to be packaged are received in the inlet and where the cylinder contains a piston operable from first position to receive product through the inlet to a second position to emit the food product from the outlet wherein the cylinder includes sterilizing fluid passageway to selectively admit sterilizing fluid to the cylinder to expose the internal surfaces of the cylinder and the piston to the sterilizing fluid.

A second dispensing cylinder can also be provided to receive the food product and direct it to the food container.

Examples in accordance with the present invention are discussed hereinafter with respect with the accompanying drawing but will be understood that various other arrangements also within the scope of the present invention will occur to those skilled in the art upon reading the disclosure setforth hereinafter.

BRIEF DESCRIPTION OF THE DRAWING

Examples in accordance with the present invention are shown with the accompaning figures wherein.

DETAILED DESCRIPTION OF THE DRAWINGS

Figure 1:
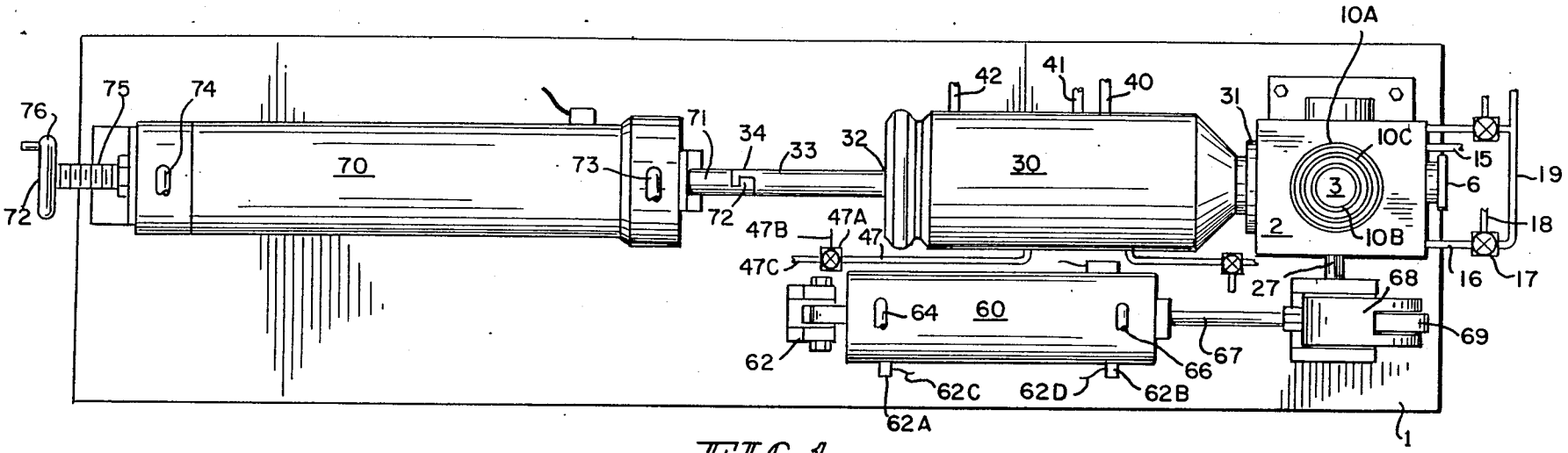
FIG. 1 a plan view of a filling device arrangement within the scope of the present invention.

Referring now to FIG. 1, which shows a plan view of a part of an arrangement within the scope of the present invention, a base 1 is provided to receive a rotor assembly 2 as shown in more detail in FIGS. 6–9 and described hereinafter, connected to base 1. Rotor assembly 2 has an outlet 31 for admission and emission of product to a cylinder 30 which operates as described in FIGS. 11A–11D. An inlet 3 is provided to receive a source for a sterilized food product to be processed, such as a vessel, or a pipeline (not shown). Rotor assembly 2 further includes a rotor member 26 having internal passageways 8D, the description of which is best illustrated in FIGS. 6–9. Rotor assembly 2 further includes a product connection 6 for emission of product from the filling cylinder to a dispensing valve as described hereinafter.

One objective of the present invention is to provide aseptic filling of the food product. In this regard it is important to prevent inward migration of bacteria into the filling apparatus. In general the present invention accomplishes this objective by the use of spaced apart seals in some locations as described hereinafter along with the use of steam intermediate the seals to kill any bacteria which may attempt to enter the device.

Such an arrangement is utilized in rotor block assembly 2. For example with respect to inlet 3, groove 10C is a steam chase and adapted to receive live steam from a steam inlet 15 by means of internal conduits in the block as described with reference to FIGS. 7 and 8.

The steam is emitted by means of an outlet 16 which communicates with groove 10C and outlet 16 is connected with a valve 17 operable between first position to communicate with a condensate verification line 18 and an outlet 19 which is connected to a backpressure condensate trap which determines the temperature of the steam in the system.

Figures 6, 7, 8, 9:
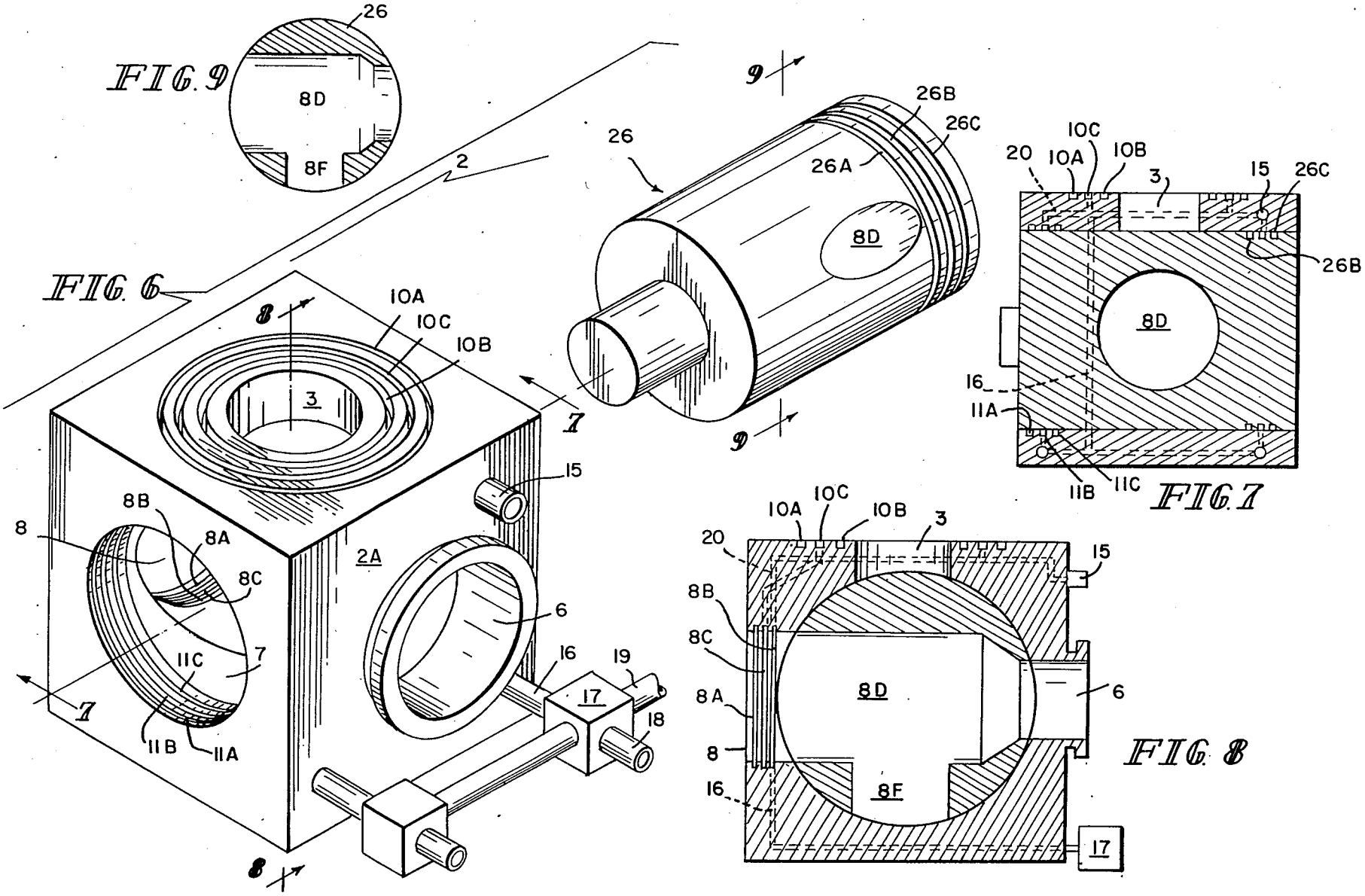
FIG. 6 is a perspective exploded view of a rotor block within the scope of the present invention.
FIG. 7 is a view taken along a plane passing through line 7—7 of FIG. 6.
FIG. 8 is a view taken along a plane passing through line 8—8 of FIG. 6.
FIG. 9 is a view taken along a plane passing through line 9—9 of FIG. 6.

Seals, for example "0" rings, are provided in grooves 10A, 10B and it will be understood that by the arrangement shown any bacteria which migrates past the seal provided in groove 10A must traverse groove 10C where it is exposed to the high temperature live steam and is killed. The "0" ring provided in groove 10B also prevents leakage of steam or condensate into the process food. Similar arrangements are provided at each of the openings to rotor block 2A as shown in FIGS. 6–8.

Figure 5:
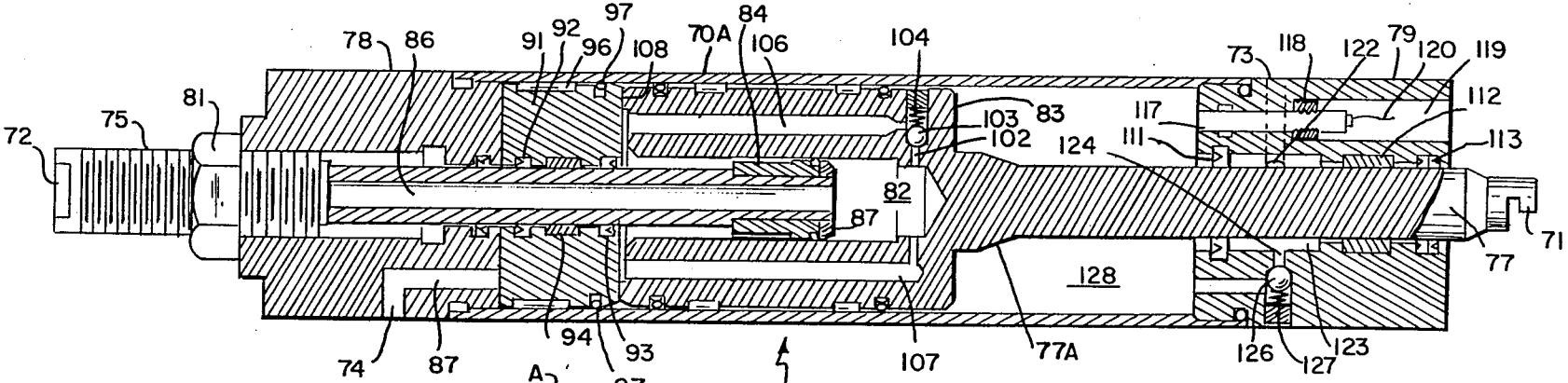
FIG. 5 is a cross section of one example of an actuating cylinder within the scope of the present invention.

Product cylinder 30 which is provided to receive food to be processed and to meter the quantity of food to be supplied to the container (not shown) is operated by an adjustable two position cylinder in accordance with one feature in the present invention. FIG. 5 illustrates one example of a two position piston 70 in cross section. The piston includes a tubular shell 70A with an adjustment end cap 78 to receive adjustment shaft 75 and a rod end cap 79 to receive rod 77 which connects to shaft 33 by means of interlock 71.

Shaft 75 is threaded as shown to be received by a lock nut 81 to engage cap 78 to retain shaft 75 in a selected position in chamber 82 defined in a piston 83 carried by shaft 77.

A piston stop 84 is carried at the end of shaft 75 and is provided with groove 87 to receive a seal, for example an "0" ring. Thus, rotation of shaft 75 locates piston stop 87 at selected locations in chamber 82 to limit movement of piston 83 and shaft 77 in the extending direction as described hereinafter, to set the movement of the piston in cylinder 30 to regulate the quantity of food supplied by cylinder 30 during each cycle. Shaft 75 is tubular, as shown and defines a conduit 86 which communicates with exhaust 72 so that piston 83 can be moved to an extended position in tube 70A by fluid pressure at inlet/exhaust 72 where the fluid is exhausted from inlet/exhaust 72 when piston 83 is withdrawn.

Adjustment endcap 78 further includes inlet/exhaust 74 which communicates by means of a conduit 87 with a piston 91 which moves on shaft 75, as shown where a bearing 94 is provided in a groove therein to engage shaft 75 and seals 92, 93 in this case circular cup seals, as described hereinafter are provided on opposite sides of bearing 94. Piston 91 further engages the inner surface of tube 70A and a bearing ring 96 and cup seal 97 are provided.

In operation, fluid pressure at inlet/exhaust 74 urges piston 91 in the direction indicated by arrow A until piston 91 abuts stop 84 to limit the movement of piston 91 in the direction shown by arrow A and likewise limit the movement of shaft 33 of product cylinder 30 in direction B. A second stroke length is provided when the fluid is exhausted through inlet/exhaust 74, as described hereinafter, so piston 91 is moved in the direction shown by arrow B to engage endstop 78 and allow full retraction of piston 83.

Piston 83 is moved in direction A by fluid pressure in cavity 82 from inlet/exhaust 72 where the fluid flows through conduits 101, 102 where conduit 102 can include a check valve assembly consisting of a ball 103 which seats in conduit 102 and a spring 104. Conduit 102 communicates with a conduit 106 and conduit 101 communicates with a conduit 107.

The two conduits are utilized to provide pressure for movement of piston 83 and the check valve assembly prevents use of the conduit 106 for exhaust during the last portion of the movement of piston 83 in direction B to provide cushioning where piston 83 strikes piston 91. The cushioning occurs regardless of the position of shaft 75 and stop 84.

The conduits 106, 107 comunicate with the end of piston 83 next to piston 91 where a lip 108 is provided to offset piston 83 and allow area for exertion of pressure to provide sufficient force for movement of the piston.

Rod end cap 79 receives rod 77 carried by piston 83 and includes ring bearing 112 and seal 113 to engage and seal rod 77.

Likewise a proximity switch 117, as is known in the art, can be located in cap 79 by means of threaded bushing 118 located in a cooperative aperture 119 to sense the presence of piston 83 to provide a signal 120 to a controller (not shown) which sequences operation of the device.

Inlet/exhaust 73 is provided in cap 79 which communicates with an outlet 122 to a chamber 123 behind seal 111 which can be a cup seal which does not engage shaft 77 but does engage cushion spud 77A when shaft 77 is fully extended. Chamber 123 communicates with a conduit 124 which includes a check valve assembly including a ball 126 and spring 127. A second, restricted flow conduit (not shown) is provided to restrict flow of air out of chamber 128 when cushion spud 77A engages seal 111 to cushion the impact of piston 83 striking end cap 79. When pressure is applied to inlet 73, check valve, assembly 126, 127 allows passage of air for retraction of piston 83 in the direction shown by arrow B and when cushion spud 77A is withdrawn from seal 111 air is also allowed to flow through the annular space between shaft 77 and seal 111.

Figure 12B:
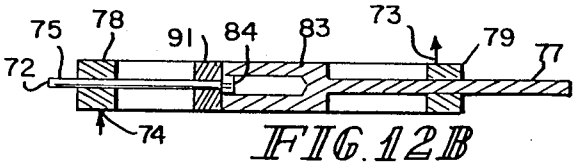
FIGS. 12A–12E illustrate sequentially operation of a two position piston within the scope of the present invention.
Figure 12D:
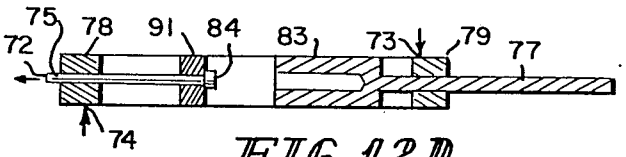
Figure 12A:
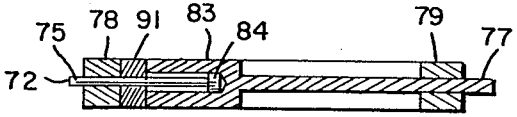
Figure 12C:
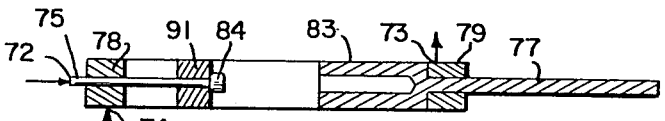
Figure 12E:
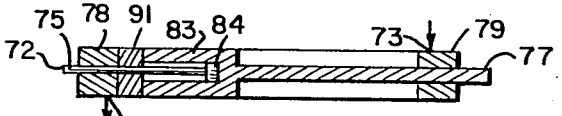

FIGS. 12A-12E illustrate operation of the device shown in FIG. 5. Shaft 75 is shown with inlet 72 which is carried by cap 78. In FIG. 12A piston 91 and piston 83 are in the configuration shown in FIG. 5 with stop 84 located within the cavity 82 of piston 83. Shaft 77 is shown in the fully retracted position within in cap 79. In FIG. 12B pressure has been applied to inlet 74 to force piston 91 and piston 83 forward to a point determined by shaft 75 so that piston 91 abuts stop 84. It will be noted that rod 77 has been extended accordingly and air is exhausted from inlet/exhaust 73. In FIG. 12C pressure has been applied through inlet 72 and emitted though the aperture and stop 84 to force piston 83 forward and extend rod 77 during which air is exhausted from inlet/exhaust 73. FIG. 12D illustrates retraction of rod 77 where air is applied through inlet/exhaust 73 and air is exhausted through inlet/exhaust 72. During this time it will be noted that air pressure is continually applied through inlet/exhaust 74. FIG. 12E illustrates the arrangement on full retraction and return to the configuration shown in FIG. 12A where air is supplied through inlet/exhaust 73 to force piston 83 and piston 91 against endcap 78 while air is exhausted from inlet-/exhaust 74.

Referring again to FIG. 1, base 1 carries a product measuring cylinder 30 as described hereinafter with a shaft 33 located in an output aperture 32 as known in the art where an interconnect 72–34 is provided between shaft 33 of product cylinder 30 and shaft 71 of a double acting piston 70.

A second double acting cylinder 60 is provided to operate rotor 26 in a double acting mode having exhausts 64–66, to operate a piston (not shown) within the cylinder to selectively operate an output shaft 67 in a back and forth motion. Cylinder 60 is mounted to base 1 by means of a pivot assembly 62. Shaft 67 of piston 60 is connected through a connector 69 to an arm 68 which rotates a shaft 27 of a rotor 26 shown in FIG. 5 which controls the flow of product through rotor assembly 2 as described hereinafter. Proximity switches 62A 62B are located at the limits of travel of the piston of cylinder 60 and provided with outputs 62C, 62D respectively to provide signals to the controller which sequences operation of the device.

Figure 3:
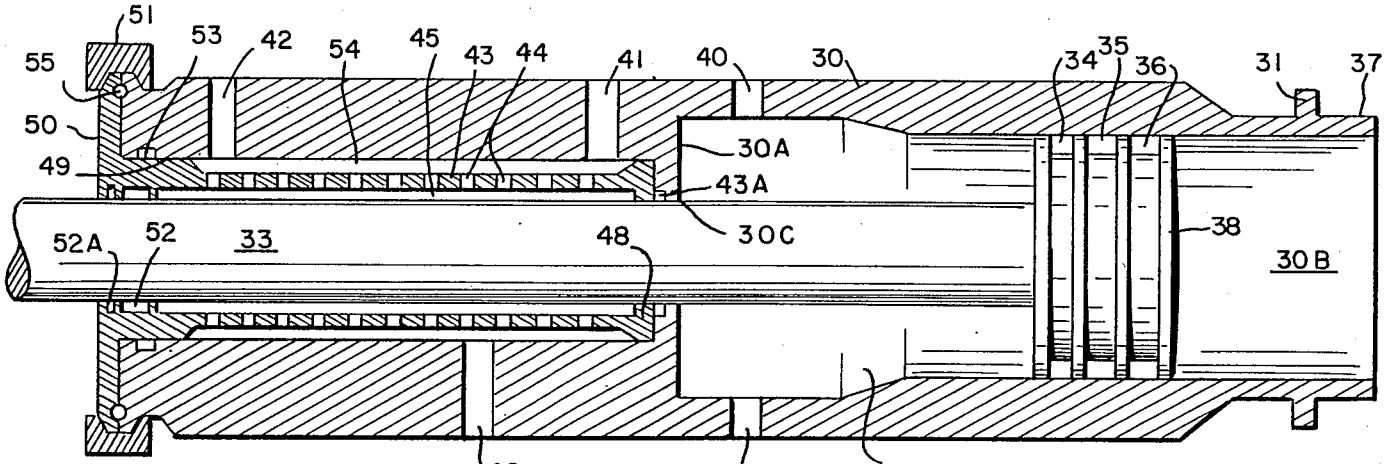
FIG. 3 is a cross section view of a cylinder within the scope of the present invention.
Figure 10:
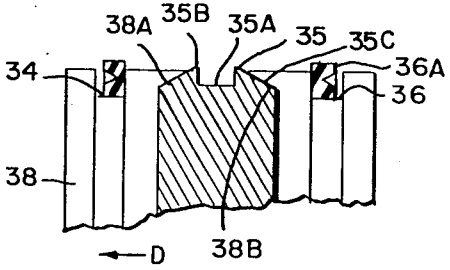
FIG. 10 is an enlarged view of seal and bearing arrangements utilized in devices in accordance with the present invention.

A crossection view of product cylinder 30 is shown in FIG. 3 where, as shown, product cylinder 30 includes an outlet 37 adapted to receive and admit product from the rotor assembly where the outlet 37 is received in aperture 8 of rotor assembly 2 with a shoulder 31 resting against the surface of the rotor assembly. It will be understood that shoulder 31 can be secured to rotor assembly 2 by latch means (not shown). Cylinder 30 includes a cavity 30B, to receive a piston 38 where piston 38 is carried by a shaft 33 and has grooves 34, 36 to receive a seal such as cup seals, as described hereinafter and a bearing as shown in FIG. 10 received in especially shaped groove 35 in piston 38 interediate the grooves 34, 36. Piston 38 moves back and forth in cylinder 30. Cylinder 30 further provides an enlarged section 39 so that when the piston is completely withdrawn cylinder 70 is in the position shown in FIG. 12A and 12E with piston 39 in the enlarged portion of the cylinder to be exposed to sterilizing steam supplied through an inlet 40 from a source (not shown) where condensate outlet 47 is provided for emission of steam and condensate to a valve 47A with outlet 47B for condensate verification and outlet 47C for back pressure condensate as shown in FIG. 1. Thus when the piston 38 is withdrawn to enlarged portion 39 it is exposed to sterilizing steam to kill any bacteria present to prevent contamination of the food products being handled. This advantageously allows direct steam contact with the pistons, seals and bearings to allow more rapid sterilization than available in other technique and further allows the elimination of internal thermocouples and instrumentation which would otherwise be required.

Shaft 33 passes through a wall member 30A of cylinder 30 and through a chamber 54 which is adapted to contain a perforated tube assembly 50 including a tube 43 which extends inwardly into Chamber 54. Tube 43 extends into chamber 54 with end member 48 received near the wall 30A of cylinder 30 to provide a seal with a cup seal 43A received in a groove of wall 30A. Spaced radially extending apertures 44 are provided in tube 43 to admit steam from chamber 54 to chamber 45 defined between the shaft 33 and the tube 43 to steam the portion of the shaft which is inserted into the piston chamber of the cylinder 30. Steam is admitted through two inlets 41, 42 and a condensate outlet 46 is provide for emission of condensate to outlet 47. Seal 53 is provided between cylinder 30 and a seal surface 49 of tube assembly 50. A second seal 52A can be provided in tube assembly 50 and a bearing 52 can be provided to engage shaft 33. A fastener 51 is provided to be located around a groove in cylinder 30 and the beveled edge of tube assembly 50 to retain the assembly in a closed position. Also an "0" ring seal 55 can be provided as shown between tube assembly 50 and the outer surface of cylinder 30. In operation, as described in more detail hereinafter, piston 38 moves back and forth in cylinder 30 for receiving and emitting product from and to product assembly 2. The piston 38 can be withdrawn to the enlarged portion 39 of the cylinder for sterilization prior to initation of operation. In operation steam can be continuously admitted to Chamber 54 to sterilize the portion of shaft 33 which enters product Chamber 54 and the portion of the shaft which is exposed to the atmosphere during intake of product. Seal 30C isolates Chamber 30B to allow the maintenance of differential pressure in Chambers 30B and 54. In this regard the inlet 40 can be provided with steam when desired or if the product will not withstand high temperatures, cool, sterile air can be supplied to inlet 40 and emitted from outlet 47 during operation.

FIG. 10 is an illustration of a bearing and seal arrangement which, as previously discussed, can be utilized in the device. In FIG. 10 which for convenience will be described with reference to the arrangement provided for piston 38 a Teflon ® (Dupont) bearing 35' is provided having a groove 35A around the periphery. The edges 35B 35C are chamfered to be received in cooperative lips 38A, 38B of piston 38. It has been found that the arrangement shown allows the piston to be steamed without distorting the bearing because expansion resulting from the temperature of the steam is concentrated in the groove without damaging the bearing and upon cooling the bearing returns to its normal configuration. As shown, a first cup seal (shown in cross section) is received in groove 34 and will allow limited passage of fluid in the direction indicated by arrow D but not in the opposite direction. A similar seal 36A is provided in groove 36 to permit flow in the direction opposite to arrow D.

Detailed drawings of the rotor assembly 2 are shown in FIGS. 6–9 where a rotor block 2A is shown with inlet 3 surrounded by grooves 10A–10C. Rotor receiving aperture 7 is also shown and product cylinder 30 is received in opening 8 and an outlet 6 is provided to communicate with a dispensing cylinder described hereinafter. Steam inlet 15 can be provided to supply steam to the internal steam chasings of the rotor block by means of a conduit 16 described hereinafter. Rotor 26 is provided to be received in aperture 7 of rotor assembly 2. Rotor block 2A can include grooves 11A, 11B and 11C where grooves 11A and 11C are provided on opposite sides of the steam groove 11B, as shown in FIG. 7 to receive seals, for example "0" rings as shown in FIG. 10 and a steam chase 10C around the edges of the rotor to receive sterilizing steam from the internal passageways of the block 2A to prevent the immigration of bacteria or other foreign materials into the food being processed and to kill any bacteria which may be present. Likewise rotor 26 has grooves 26A–26C where grooves 26A and 26C receive "0" ring seals and groove 26B receives steam for sterilization. Steam conduit 20 is provided in block 2A inwardly from the opening 7 to supply steam from a steam inlet 15 to supply steam to chases 11B and 26B. Groves 8A-8B are provided in opening 8 to receive, for example "0" ring seals to provide a seal to seal inlet 8 and the lip 37 of product cylinder 30. As shown in FIG. 7 one leg of conduit 16 communicates with groove 8C to provide steam sterilization where the outlet communicates with condensate/outlet 16.

The condensate outlets from the various steam chases 8C, 10C, 11B, 26B are shown connected by means of conduit 16 to valve 17 which communicates with back-pressure condensate trap return 19 and bleed air by means of air bleed 18. In preferred embodiment each of the steam chases would have its own outlet arrangement.

FIG. 8 is an illustration of the internal passage ways within the rotor where passage way 8D is provided to communicate with both the aperture 8 of rotor block 2 for the input and output of material to be packaged where rotor 26 can be rotated so passageway 8D is in a vertical direction to communicate with inlet 3 to admit the food product to the product cylinder by means of second lateral passage way 8F provided radially from passageway 8D to be rotated to aligned relation with the aperture 8 when conduit 8D is in alignment with inlet 3 to conduct the product to the piston cylinder 30.

Figure 4:
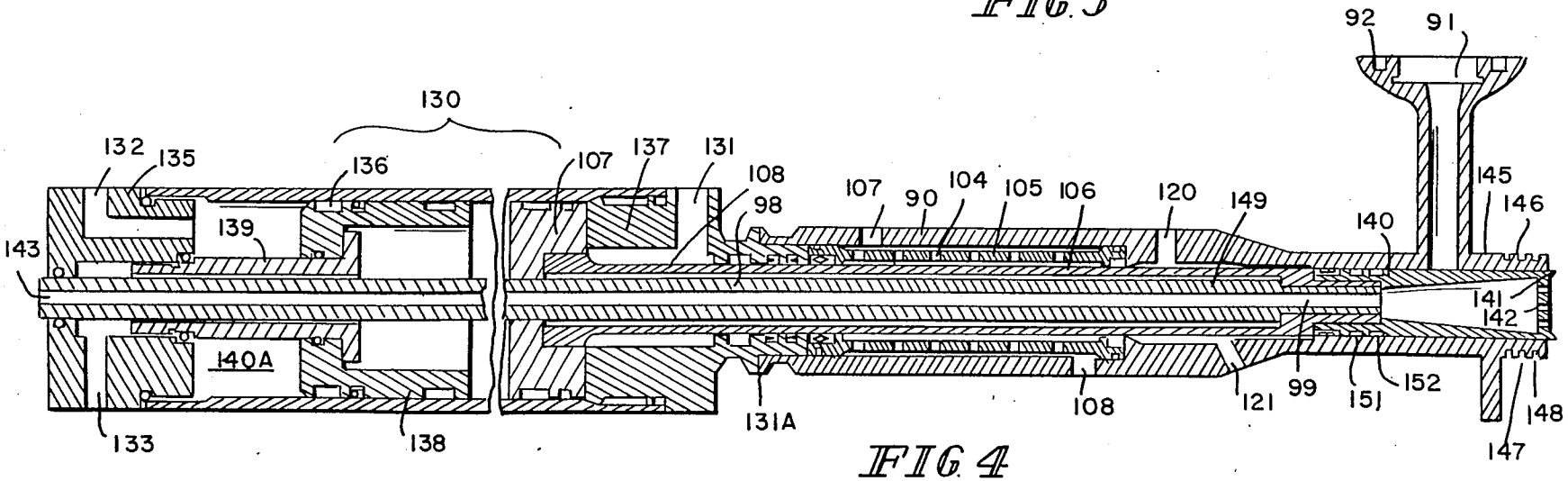
FIG. 4 is an example of a dispensing valve arrangement within the scope of the present invention.

Within the scope of the present invention various means can be provided for handling the product as it is emited from outlet 6 and one example of an arrangement is shown in FIG. 4 where a product dispensing cylinder is illustrated. Dispensing cylinder 90 includes and inlet 91 having a lip 92 to connect with outlet 6 of rotor block 2A. A double acting piston 130 is connected to cylinder 90 at a joint 131A. A shaft 98 is provided within cylinder 90 and piston 140 having a central conduit 99 for air or steam and is contained within a second tubular shaft 106 where both can be connected together and carried by a piston 107 which is reciprocated in response to air pressure to open and close the valve as described hereinafter. An enlarged section 104 is provided to receive a perforated tube 105 to allow steam from an inlet 107 to expose shaft 106 to steam for sterilization. An outlet 108 is provided for condensate. An endcap 135 is provided to be received by tube 136 which forms the wall of cylinder 130 and a second endcap 137 is received at the opposite end. Piston 130 like piston 70 is a two position cylinder having a first position as shown in FIG. 4 where piston 138 is against stop 139 and maintained in position by air applied to Chamber 140A through inlet/exhaust 132 and a second position against endcap 135 when air is exhausted from inlet exhaust 132. Air is supplied for movement of piston 107 by means of exhaust 131, 133. The operation of the device is similar to that of piston 70 except that the position of stop 139 is fixed.

Tubular shafts 106, 98 are connected to move together and are connected to a piston 140 which moves to open and close inlet 91. Piston 140 is tubular and includes knife edge 141 and blow off holes 142 so that when the piston is moved to close inlet 91 steam or sterile air can be supplied by means of inlet 143 to blow off any remaining food particles prior to the succeeding cycle. Grooves 146 and 148 can be provided in outlet 145 where the grooves receive "0" ring seals for preventing migration of bacteria and steam can be applied to groove 147 to kill any inward migrating bacteria as previously described with reference to other seals. Piston 140 moves back and forth in response to movement of shafts 106, 98 in response to air pressure at exhausts 131, 133 in sequence with the operation of the device. A bearing as described in FIG. 10 and cup seals 151, 152 can be provided in groove of piston 140 as shown.

Figure 11A:
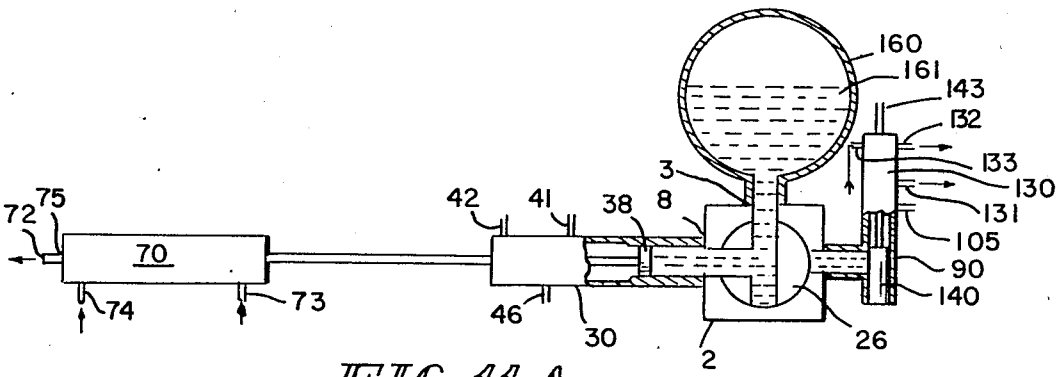
FIGS. 11A–11D illustrate, sequentially the operation of the example of a device within the scope of the present invention as shown in the Figures.

Operation of the assembled device is shown in FIGS. 11A–11E where in FIG. 11A a vessel 160 containing food product 161 has been connected to the inlet 3 to rotor assembly 2. In the configuration shown in FIG. 11A the filling cycle is illustrated where the pressurized surge tank 160 is provided to keep the particulate matter in suspension for distribution as the product cylinder is filled. It will be noted the rotor 26 has rotated to the position where inlet/outlet 8D receives food supplied to the product cylinder 30 and piston 38 is withdrawn having pushed food into the product cylinder. Piston 140 of cylinder 90 is in the extended position blocking the inlet 91 to the dispensing cylinder.

Figure 2:
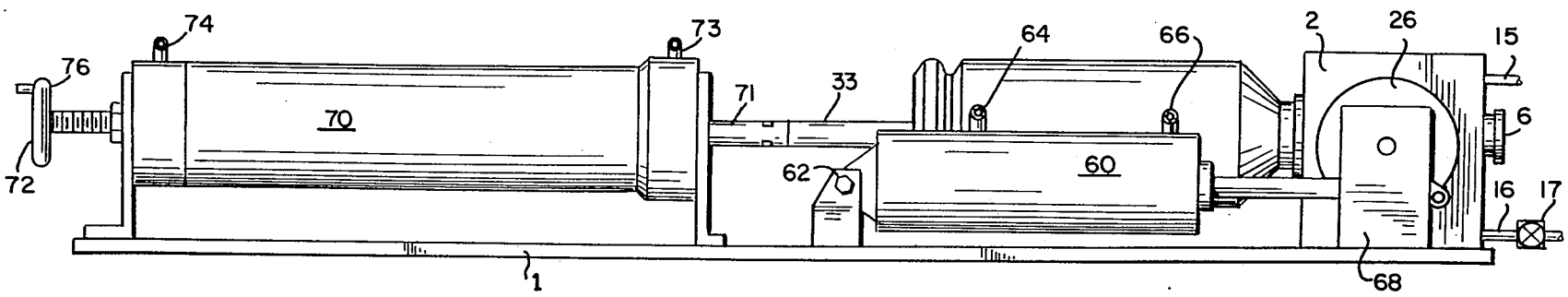
FIG. 2 is an elevational view of the arrangement shown in FIG. 1.
Figure 11B:
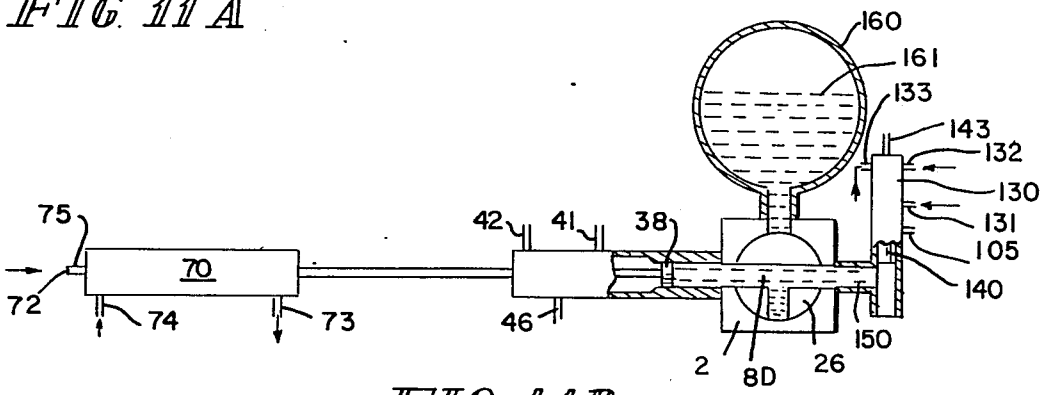
Figure 11C:
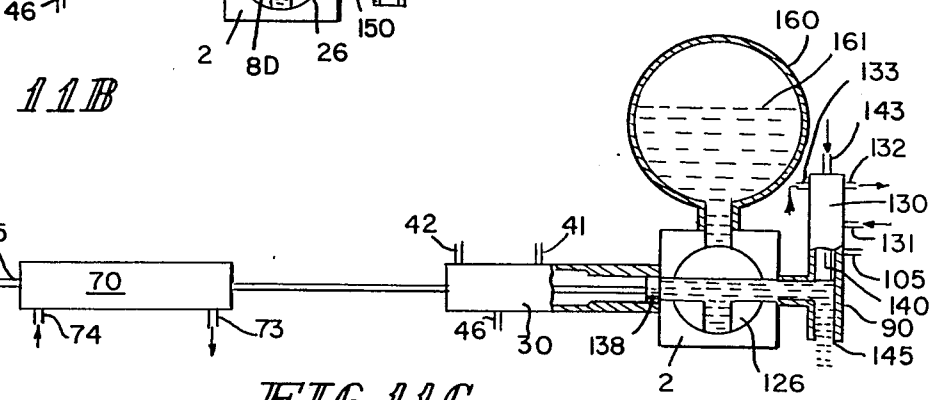

In FIG. 11B rotor 26 has been rotated by cylinder 60 illustrated in FIGS. 1 and 2, to a position where the conduit 8D communicates with the product cylinder 30 and where the Piston 140 of cylinder 90 has been withdrawn so that product, upon forward movement of piston 38, passes through passageway 8D of the rotor and out through a connector 150 between rotor block 2 and cylinder and then through the inlet 91 of cylinder 90. In FIG. 11C which illustrates the continuation of the filling cycle piston 38 has moved further toward rotor block to admit the food product to dispensing cylinder 90 where Piston 140 is still withdrawn and the product continues to flow out of outlet 145. During this period steam or sterile air can be admitted through inlets 41, 42 of cylinder 30 and inlet 105 of cylinder 90 as previously discussed.

Figure 11D:
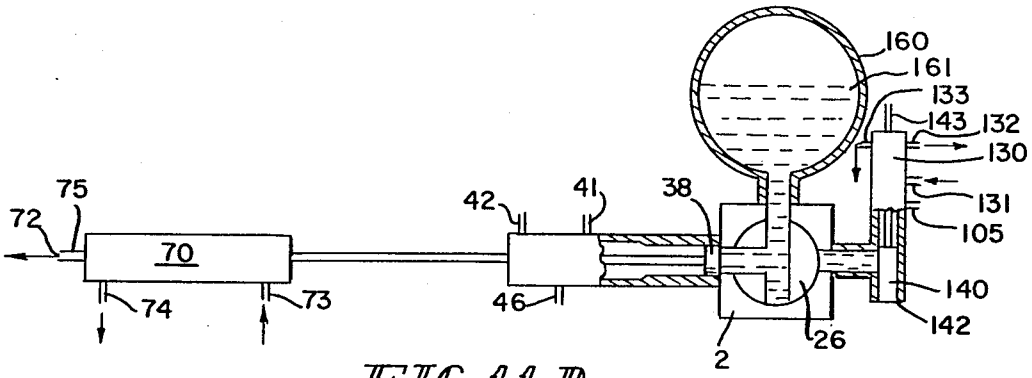

FIG. 11D illustrates the completion of the dispensing cycle where upon full extension of the product cylinder 38 the rotor block outlet is sealed off by extension of Piston 140 and the product is cleared from Piston 140 by the means of air admitted through inlet 143 to be emitted through the apertures 142. At this point in normal operation the piston 38 would then withdraw in cylinder 30 to again load the product cylinder for the next dispensing cycle.

Figure 11E:
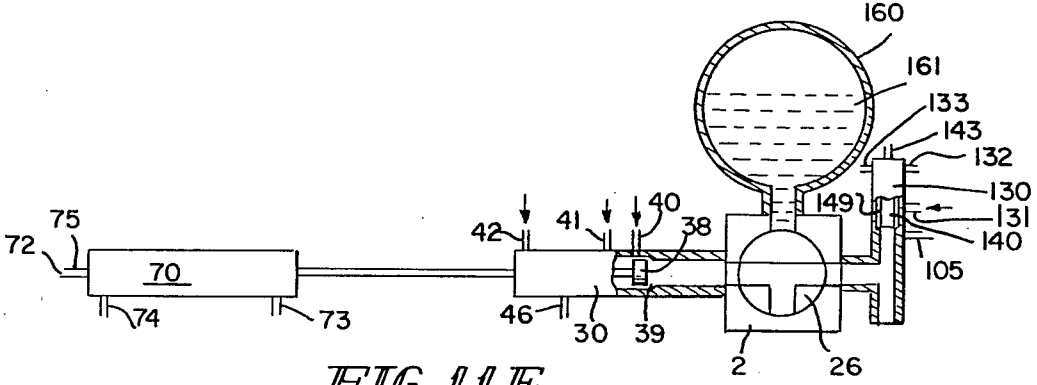

FIG. 11E illustrates the sterilization cycle which could occur prior to filling where the Piston 140 is withdrawn, and where steam is applied through the inlet 105 as illustrated in FIG. 4 for sterilization of the exposed portions of the shaft 106 and the Piston 140 in the enlarged portion 149 of cylinder 90. Likewise, steam is admitted through the inlets 40, 41, 42 of the product cylinder 30 with the piston 38 withdrawn to enlarged portion 39 so that the piston 38 and the shaft 33 are exposed to sterilization steam.

It is to be understood that in normal operation the control and sequencing of the operation would occur by means of a controller (not shown) which senses the position of the various pistons and operates the rotor block, air inlets and exhausts and other elements of the system. Further portions of the elements can be continuously steamed, as for example by applying steam to inlet 105 of piston 90 and 41, 42 of cylinder 30.

It is to be understood that the forgoing is but one example of an arrangement within the scope of the present invention and various other arrangements also within the scope of the present invention will occur to those skilled in the art upon reading the disclosure set forth hereinbefore.

The invention claimed is:

1. An arrangement for dispensing fluid material including a cylinder having a cylindrical body defining a first cavity of first diameter and having cylinder inlet means to receive said fluid in said cavity and fluid outlet means for emission of fluid from said first cavity, piston means having a diameter generally equal to said first diameter received in said first cavity and moveable from first position to second position to admit fluid through said inlet means to said first cavity and from said second position to said first position for emission of said fluid through said fluid outlet means where said cylindrical body has a second cavity of second selected diameter greater than said first diameter and wherein said piston means can be selectively moved to third position within said second cavity, second fluid inlet means to said second cavity whereby said piston means can be exposed to second fluid when said piston means is located in said second cavity and piston rod means connected to said piston means to move said piston means to said first and second cavities and wherein said cylindrical body includes third cavity means having a diameter greater than said rod diameter, seal means to provide fluid seal between said third cavity and said first and second cavities; and third fluid inlet means communicating with said third cavity for admission of third fluid to said third cavity to expose said piston rod means to said third fluid.

2. The arrangement of claim 1, further comprising an elongated tube assembly disposed within said third chamber, said tube assembly defining an inner space that is sized to receive said piston rod and is formed to include a plurality of apertures that provide fluid communication between said third fluid inlet means and said inner space to selectively expose said piston rod to said third fluid.

3. The arrangement of claim 2, wherein said third fluid is steam.

* * * * *

UNITED STATES PATENT AND TRADEMARK OFFICE

CERTIFICATE OF CORRECTION

PATENT NO. : 4,699,297

DATED : October 13, 1987

INVENTOR(S) : Glen F. Raque et al

It is certified that error appears in the above-identified patent and that said Letters Patent is hereby corrected as shown below:

In the Abstract, at line 11, change "poston" to --piston--.

In Column 2, at line 22, after "Fig. 1", insert --is--.

In Column 2, at line 44, change "11D" to --11E--.

In Column 2, at line 58, change "outlet" to --inlet/outlet--.

In Column 2, at line 60, change "11D" to --11E--.

In Column 3, at line 53, change "exhaust" to --inlet/exhaust--.

In Column 4, at line 46, delete the comma after "valve".

In Column 4, at line 56, change "in cap" to --end cap--.

In Column 5, at lines 14 and 15, change "exhausts" to --input/exhausts--.

In Column 5, at line 29, change "outlet" to --inlet/outlet--.

In Column 5, at line 62, change "Chamber" to --chamber--.

In Column 6, at line 3, change "provide" to --provided--.

In Column 6, at line 19, change "Chamber" to --chamber--.

In Column 6, at line 20, change "Chamber" to --chamber--.

In Column 6, at line 23, change "Chamber" to --chamber--.

UNITED STATES PATENT AND TRADEMARK OFFICE

CERTIFICATE OF CORRECTION

PATENT NO. : 4,699,297

DATED : October 13, 1987

INVENTOR(S) : Glen F. Raque et al

It is certified that error appears in the above-identified patent and that said Letters Patent is hereby corrected as shown below:

In Column 6, at line 24, change "Chambers" to --chambers--.

In Column 7, at line 4, change "Groves" to --Grooves--.

In Column 7, at line 31, change "emited" to --emitted--.

In Column 7, at line 34, change "and" to --an--.

In Column 7, at line 55, change "exhaust" to --inlet/exhaust--.

In Column 8, at line 3, change "exhausts" to --inlet/exhausts--.

In Column 8, at line 63, change "forgoing" to --foregoing--.

In Column 9, at line 8 (Claim 1), change "moveable" to --movable--.

Signed and Sealed this

Thirteenth Day of September, 1988

*Attest:*

DONALD J. QUIGG

*Attesting Officer*

*Commissioner of Patents and Trademarks*